United States Patent [19]

Käch

[11] 4,216,449

[45] Aug. 5, 1980

[54] WAVEGUIDE FOR THE TRANSMISSION OF ELECTROMAGNETIC ENERGY

[75] Inventor: Alfred Käch, Untersiggenthal, Switzerland

[73] Assignee: BBC Brown Boveri & Company Limited, Baden, Switzerland

[21] Appl. No.: 868,840

[22] Filed: Jan. 12, 1978

[30] Foreign Application Priority Data

Feb. 11, 1977 [CH] Switzerland ..... 1661/77

[51] Int. Cl.[2] ..... H01P 3/06; H01P 3/12

[52] U.S. Cl. ..... 333/236; 333/242; 333/243

[58] Field of Search ..... 333/84 R, 95 R, 95 S, 333/96, 236, 239, 240, 242, 243

[56] References Cited

U.S. PATENT DOCUMENTS

| | | | |
|---|---|---|---|
| 2,929,034 | 3/1960 | Doherty | 333/84 R |
| 3,603,899 | 9/1971 | Gyorgy et al. | 333/95 R X |
| 3,668,574 | 6/1972 | Barlow | 333/95 S |
| 3,703,690 | 11/1972 | Ravenscroft et al. | 333/95 S |
| 3,845,426 | 10/1974 | Barlow | 333/95 S |

*Primary Examiner*—Paul L. Gensler

*Attorney, Agent, or Firm*—Oblon, Fisher, Spivak, McClelland & Maier

[57] ABSTRACT

A waveguide for the transmission of electromagnetic energy which has a low attenuation even with a small line cross-section realized by disposing in the interior of an electromagnetically shielded hollow cylinder, consisting of a substance having a low permittivity, a dielectric wire of a substance having a high permittivity. An $E_{om}$-wave (m = 1, 2, 3 . . . , circular H field) is excited in the dielectric wire and the dimensioning of the dielectric wire is such, depending on the permittivities of the two substances and the particular operating frequency, that a TEM wave develops at least substantially in the space in the dielectric hollow cylinder. In the simplest case, the electromagnetic shield can consist of a metal tube and the dielectric hollow cylinder can consist primarily of air. Furthermore, the $E_{om}$ wave excited in the dielectric wire is preferably the $E_{01}$ wave ($TM_{01}$ mode).

13 Claims, 8 Drawing Figures

WAVEGUIDE FOR THE TRANSMISSION OF ELECTROMAGNETIC ENERGY

BACKGROUND OF THE INVENTION

The invention relates to a waveguide for the transmission of electromagnetic energy, which has a low attenuation even with a small line cross-section.

The known forms of line for the transmission of electromagnetic energy can be divided, in principle, into open and shielded systems. The Sommerfeld line, the Harms-Goubau line and the dielectric line inter alia, belong to the first group, the coaxial line and the various hollow waveguides for example, belong to the second group. The coaxial cable and the rectangular waveguide, in particular, are of practical importance for relatively short transmission distances and the Harms-Goubau line and particularly the circular waveguide ($H_{01}$-wave) for low-loss transmission over greater distances and are used for long-distance traffic.

With the open line (wire waveguide) the more immediate vicinity of the conductor medium predominantly participates in the energy transport, while the line itself, merely affords a loose guiding. A prerequisite for this, however, is that the field strengths in the outside space decrease in accordance with a Hankel function with increasing distance from the conductor axis, that is to say disappear almost exponentially towards the outside. The extent of the field drop depends on the dimensions and material constants of the line and on the particular operating frequency. The great advantage of the open line (for example, the Harms-Goubau line) is known to lie in the low transmission attenuation. A disadvantage, on the other hand, is the relatively large diameter of the circular cross section which is necessary in comparison with the wavelength of operating frequency and through which 90% or 99% of the energy is transmitted, because allowance must be made for this, for example, in the mounting of the conductor (laying and supporting). A further particularly great disadvantage is the susceptibility of the open line to trouble with regard to hoarfrost and icing.

The behaviour of the coaxial line as regards attenuation is sufficiently well known. With a specific diameter ratio ($\approx 3.6$), which is independent of the frequency, the attenuation is at a minimum. It increases proportionately to the root of the frequency and can therefore assume very high values with high frequencies. Coaxial cables are therefore used for longer transmission sections only in the range of relatively low frequencies, for example, with repeaters up to 60 MHz in carrier-frequency installations. With short and very short distances, on the other hand, where the attenuation is less important, this line is of service far into the range of microwaves. In this case, however, there is the condition that the particular operating wavelength seen electrically, must always be greater than or at least equal to the periphery of the bore of the outer conductor, because otherwise higher modes appear between inner and outer conductors and may cause disturbing effects. Variations of the coaxial line are the various conductor forms in the strip-line technique, wherein even relatively high attenuation constants can be accepted into the bargain because of the extremely short lengths.

With the tubular waveguide, the attenuation is naturally considerably less than in the coaxial line because of the large tube surface and the absense of an inner conductor. In order that the tube may be permeable to electromagnetic waves, however, its width must always be larger by a certain factor in comparison with the particular operating wavelength. With low frequencies, this leads to voluminous and expensive tube cross-sections, as for example in the type WR 650, frequency range 1.14–1.73 GHz: internal dimensions 165.1/82.55 mm, wall thickness 2.03 mm. On the other hand, for a distinct mode excitation, the operating wave length should not drop below a certain value in comparison with the critical wavelength of the tube. For very high frequencies (mm waves) this means very small tube dimensions, as a result of which there is very high attenuation, for example in the type WR10, frequency range 73.8–112.0 GHz; internal dimensions 2.54/1.27 mm, attenuation 2740 db/km at 88.6 GHz.

With the exception of the $H_{om}$ wave in the round waveguide, the attenuation passes through a minimum depending on the frequency in all tubular waveguides and with all modes and then increases in proportion to the root of the frequency, as in the coaxial line. The attenuation minimum is generally above the transmission range and therefore cannot be utilized. An optimum use of the tubular waveguide is, for example, where high powers also have to be transmitted at the frequency in question so that the flashover security of the wall spacing can be utilized at the same time.

In the circular waveguide, which is operated in the $H_{om}$ mode (circular E field) preferably in the $H_{01}$ mode, it is known that the transmission attenuation decreases steadily with rising frequency. In order to obtain sufficiently low attenuation, suitable for long-distance traffic, the internal diameter of the tube must be larger by a multiple in comparison with the operating wavelength. Typical values are, for example, tube width 50–70 mm, operating frequency 60–100 GHz, transmission attenuation about 1 db/km. As a result of the relatively large diameter, numerous subsidiary modes may appear in this tube, apart from the dominant mode and may cause considerable additional losses. Their excitation is possible with the slightest deviation of the tube contour from the circular and/or straight ideal shape. Accordingly, only stable and very precisely manufactured metal tubes can be considered. Measures are also taken to decouple certain modes. In particular, these are a thin dielectric wall coating or the covering of the inner wall of the tube with a tightly wound coil of thin, enamelled copper wire. With the dielectrically coated tube, $H_{01}$ wave purification is also necessary by means of mode filter disposed at intervals, the proportion of which may amount to 2–25% of the total line length, depending on tube tolerances. In addition, a very stable laying of the line is necessary, for example, resilient embedding in protective tubes (tube-in-tube laying). Thus the use of the circular waveguide (hollow cable) for long-distance traffic is very expensive.

In general, with all conventional forms of line, a relatively large field cross-section is always necessary for a low-loss transmission. The practical use of such lines is therefore associated with great disadvantages, as the above explanations show, particularly for long-distance traffic, with regard to handling, technical and cost expense. This is obviously an important reason why today the line transmission, for example, of microwaves, has not become very widespread.

The transmission of intelligence by means of glass optical fibers is at present being fully developed. Attenuation of 5–10 db/km are expected. The long-term behavious of the fibers is unknown. Even slight opacity would have a disastrous effect on the attenuation. Also the available light efficiencies are still comparatively low, particularly in the single-fiber technique, so that the signal-to-noise ratios are lower by about 30 db than can be achieved by conventional means in communication channels.

SUMMARY OF THE INVENTION

Accordingly, one object of the invention is to provide, with conventional means, a waveguide for the transmission of electromagnetic energy which has a low attenuation even with a small line cross-section.

According to the invention, this is achieved in that, disposed in the interior of an electromagnetically shielded hollow cylinder, consisting of a substance having a low permittivity, is a dielectric wire of a substance having a high permittivity, that an $E_{om}$-wave (m=1, 2, 3 . . . , circular H field) is excited in the dielectric wire and that the dimensioning of the dielectric wire is such, depending on the permittivities of the two substances and the particular operating frequency, that a TEM wave develops at least substantially in the space in the dielectric hollow cylinder.

In the simplest case, the electromagnetic shield may consist of a metal tube and the dielectric hollow cylinder may consist primarily of air. Furthermore, the $E_{om}$ wave excited in the dielectric wire is preferably the $E_{01}$ wave ($TM_{01}$ mode).

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1A:
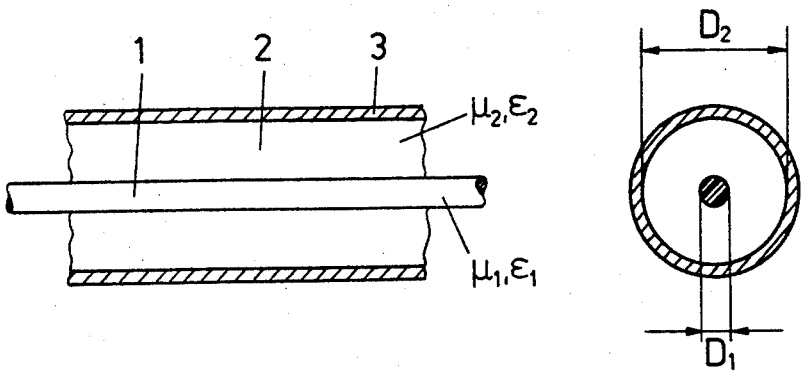
FIG. 1A shows a diagrammatical illustration of a preferred form of embodiment of the waveguide proposed according to the invention, in longitudinal and transverse view.

Referring now to the drawings, wherein like reference numerals designate identical or corresponding parts throughout the several views, and more particularly to FIG. 1 thereof, FIG. 1A shows a diagrammatical illustration of a preferred form of embodiment of the waveguide proposed according to the invention, in longitudinal and transverse view. The dielectric wave 1 with the material constants $\mu_1$ (permeability) and $\epsilon_1$ (permittivity) and the diameter $D_1$ is disposed concentrically in a circular cylindrical metal tube 3 having the internal diameter $D_2$. The medium 2 in the gap—for example air—may have (on the average) the material constants $\mu_2$, $\epsilon_2$, it being a prerequisite that, so far as possible $\mu_2\epsilon_2 << \mu_1\epsilon_1$ (see above).

Figure 2:
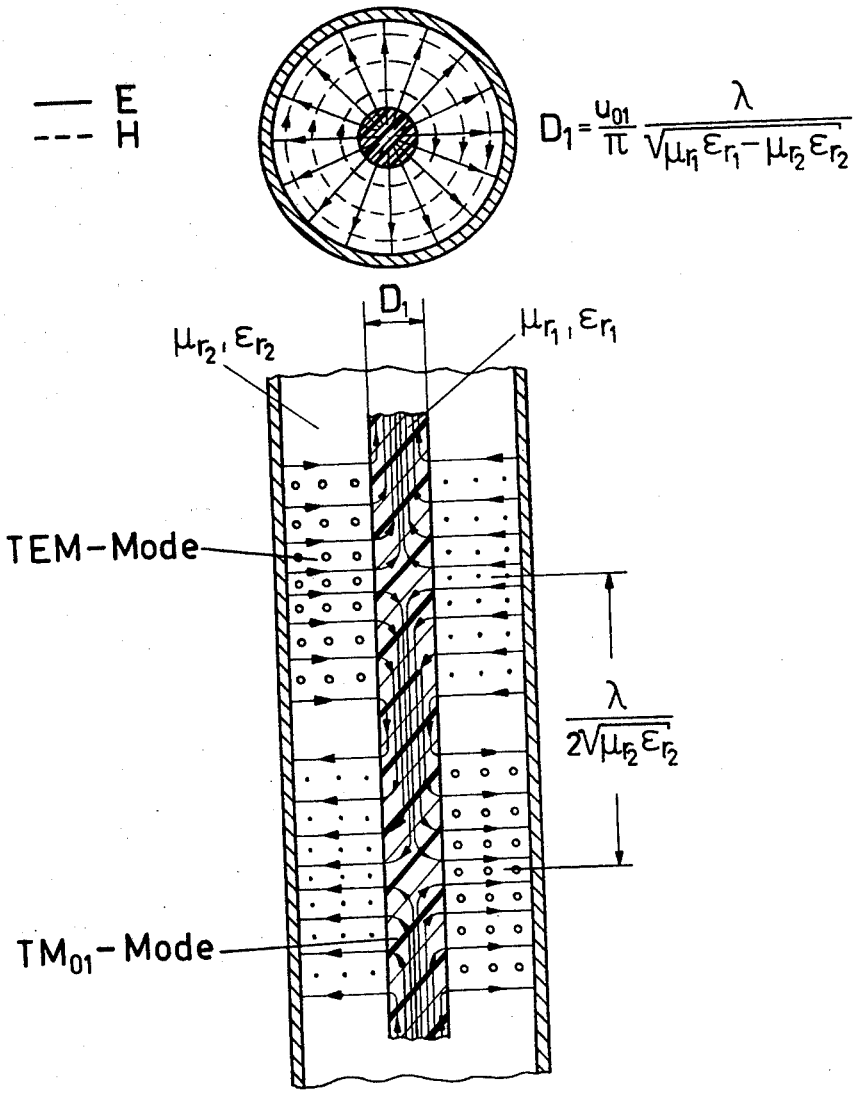
FIG. 2 shows an instantaneous picture of the field which develop when the $E_{01}$ wave is excited in the dielectric wire according to the invention.

FIG. 2 shows an instantaneous picture of the field which develops when the $E_{01}$ wave is excited in the dielectric wire according to the invention. Because $\mu_2\epsilon_2 < \mu_1\epsilon_1$, here the particular field structure is built up in the radial direction from the conductor axis. By appropriate selection of the diameter $D_1$ in comparison with the material constants $\mu_1$, $\epsilon_1$ and $\mu_2$, $\epsilon_2$ and of the particular operating frequency, a field pattern can always be imposed wherein for E-waves the longitudinal component of the electric field disappears at the surface of the dielectric wire. The electromagnetic field in the space between the dielectric wire 1 and the metal tube 3 is then precisely equal to that between inner and outer conductor of a coaxial line (TEM wave). Since the interaction (and distribution) of the field components is different in the dielectric wire from that in a metallic conducting one, however, here the transmission attenuation must behave completely differently from what is the case with the coaxial line, as will also be shown below.

Figure 1B:
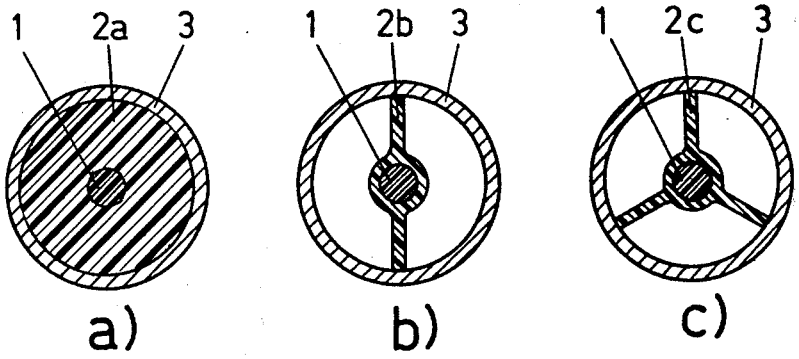
FIG. 1B shows possibilities for supporting the dielectric wire 1 in relation to the metal tube 3.

In the practical case, so far as possible, it is necessary for $\mu_2=\mu_1=\mu_0$ and $\epsilon_2=\epsilon_0$ because then the most favorable conditions are present with regard to the influence of these substance constants on the transmission attenuation (see below "attenuation conditions"). In FIG. 1B, appropriate possibilities for supporting the dielectric wire 1 in relation to the metal tube 3 are indicated. In (a) the gap is filled with a foam plastic **2*a*, in (b) the wire 1 is fixed by a double web 2*b* and in (c) by means of a three-armed web 2*c*** (for example of a plastic material). The supporting medium should, in addition, have as low a loss as possible and be homogeneous in the longitudinal direction. Naturally, a supporting of the wire at intervals is also possible. The line then has a bandpass character, however, which is unwanted in the majority of cases.

With the field pattern according to power functions imposed between dielectric wire and tube wall according to the invention, a transmission of energy is impossible without the tube. Even without the dielectric wire, a wave propagation is not possible so long as the tube diameter is kept below the critical diameter. Both components are essential for the ability of the line system to function. The tube causes the guiding of the wave to a certain extent whereas the dielectric wire causes the forming of the field component so that no longitudinal components occur in the gap, particularly with the $E_{01}$ wave. The line system does not form either a tubular waveguide or a true dielectric line and may therefore appropriately be called a "quasi-dielectric waveguide" hereinafter referred to briefly as a QD line.

An energy transmission is only possible above a certain critical frequency which (with $D_1=D_2$) depends on the selected tube diameter $D_2$ and the permittivity of the wire material. Above the critical frequency, the line system can be used into the frequency range of mm waves. The concrete application is primarily a question of the available dielectrics for the production of the dielectric wire. With very high frequencies, substances having a relatively low permittivity suffice while in th microwave range down to the dm waves, those with higher up to very high permittivity values are necessary.

THEORETICAL RESULTS

The great advantages of the proposed waveguide are apparent, in particular, in the construction of the attenuation formula and in the behaviour in comparison with the attenuation characteristics of the commonest kinds of line (coaxial line, hollow waveguide). In the following exposition, strictly circular conductor cross-sections are assumed. The emerging results also apply, however, under certain conditions, for conductors with other cross-sectional shapes (see below: Technical Progress), for example rectangular, elliptical, systems with plate-shaped shielding.

(a) General relationships

In order to recognize the general relationships, the most general case will be considered, namely the behaviour of all modes. In all line systems with a solid and air dielectric, so-called hybrid modes develop, which can be divided into two groups of the $HE_{nm}$ waves and the $EH_{nm}$ waves (n=0, 1, 2 . . . =number of aximuthal nodal planes, m=1,2,3 . . . =number of the radial field concentrations). In the special case n=0, these merge into the $EH_{om}$ or $E_{om}$ waves ($TM_{om}$ modes, circular H field) and into the $EH_{om}$ or $H_{om}$ waves ($TE_{om}$ modes, circular E field).

The conditions for the propagation of the individual modes result from the characteristic-value equation of the line system in question. In the present case, (see Teasdale et al, Proc. Nat. Electron. Conf., Chicago, Ill., 5 (1941), pages 427–441) this is:

$$n^2\left(\frac{1}{x^2}-\frac{1}{y^2}\right)\left(\frac{\mu_1\epsilon_1}{x^2}-\frac{\mu_2\epsilon_2}{y^2}\right)= \left[\frac{\epsilon_1}{x}\frac{Jn'(x)}{Jn(x)}-\frac{\epsilon_2}{y}\frac{Fn'(y)}{Fn(y)}\right]\left[\frac{\mu_1}{x}\frac{Jn'(x)}{Jn(x)}-\frac{\mu_2}{y}\frac{Gn'(y)}{Gn(y)}\right] \quad (1)$$

$$\frac{Fn'(y)}{Fn(y)}=\frac{Jn'(y)\,Nn(ay)-Nn'(y)\,Jn(ay)}{Jn(y)\,Nn(ay)-Nn(y)\,Jn(ay)} \quad (2)$$

$$\frac{Gn'(y)}{Gn(y)}=\frac{Jn'(y)\,Nn'(ay)-Nn'(y)\,Jn'(ay)}{Jn(y)\,Nn'(ay)-Nn(y)\,Jn'(ay)} \quad (3)$$

($a=R_2/R_1=D_2/D_1$), where $R_1$ equals the outside radius of the dielectric wire (1), and $R_2$ equals the inside radius of the tube (3), the pair of values x, y, being connected to the operating frequency $f=\omega/2\pi$ and the phase constant $\beta$ by $$\chi^2=(\omega^2\mu_1\epsilon_1-\beta^2)R_1^2, y^2=\omega^2\mu_2\epsilon_2-\beta^2)R_1^2 \quad (4)$$

$J_n$, $N_n$, =Bessel functions ($n^{th}$ order) of the first and second kind. From the equations (4), separated according to $\omega$ and $\beta$, there follows further:

$$x^2-y^2=\omega^2(\mu_1\epsilon_1-\mu_2\epsilon_2)R_1^2 \quad (5)$$

and $$\beta=\frac{1}{R_1}\sqrt{\frac{x^2\,\mu_2\,\epsilon_2-y^2\,\mu_1\,\epsilon_1}{\mu_1\,\epsilon_1-\mu_2\,\epsilon_2}} \quad (6)$$

With the given material constants and values of $\omega$, $R_1$ and $R_2=a.\,R_1$, the quantities x, y are clearly determined by the equations (1) and (5). Their insertion in equation (6) then provides the particular phase constant $\beta$ for the mode in question.

The equations (1) and (4) are generally valid. In particular, they also include the various special cases, for example $\mu_1\epsilon_1>\mu_2\epsilon_2$ (dielectric wire in the tubular conductor ) $\mu_2\epsilon_2>\mu_1\epsilon_1$ (dielectric ring in the tubular conductor) $\epsilon_2=\epsilon_1$, $\mu_2=\mu_1$ (homogeneous waveguide) a=1 (homogenous waveguide) $R_2=\infty$ (dielectric line). Depending on these relationships and the operating frequency, $x^2$ and/or $y^2$ can also be negative (see equation (4)). The Bessel functions in equation (1) then become modified Bessel functions, that is to say there is then a substantially exponential course instead of a periodic field structure in the radial direction. When equation (1) is solved according to the function $J_n'(x)/[x\cdot J_n(x)]$ a quadratic equation results, the solutions of which provide the pairs of values x, y for the $HE_{nm}$ waves and the $EH_{nm}$ waves.

In the present case of the dielectric wire in the metal tube it is necessary to put $\mu_1\epsilon_1>\mu_2\epsilon_2$. The transmission attenuation is primarily decisive for the electrical behaviour of the system. Its calculation with reference to the field equations including equation (1) and equation (1) and equation (5) is very difficult in the general case, however, and can scarcely be carried out in such a manner that the effective behaviour can be concretely recognized therefrom. In the sense of the present invention, however, there exists a relatively simple special case for which the calculation can be made explicity, namely when it is assumed that the cooperation of the individual quantities at the particular operating frequency is just so that here the phase constant has the value $$\beta=\omega\sqrt{\mu_2\epsilon_2} \quad (7)$$

$\beta$ then depends only on $\omega$ and the material constants of the substance in the space between the dielectric wire and the metal tube. In particular, if $\mu_2=\mu_0$, $\epsilon_2=\epsilon_0$, then the velocity of propagation of the electromagnetic wave corresponds exactly to the velocity of light in free space.

Such an operating state can always be realized. In order to recognize this, it is also possible to start from the fact that in the air-filled tubular waveguide the phase velocity is always greater than the velocity of light. If it is filled with dielectric, then with a specific permittivity, the precise velocity of light is necessarily obtained. The same behaviour also results, however, if the permittivity is selected even greater and at the same time the diameter of the dielectric cylinder is made correspondingly smaller than the tube diameter, that is to say a recess of a substance having a considerably lower permittivity is provided between cylinder wall and tube wall. In this case $\epsilon_1>>\epsilon_2$ this necessarily leads to the subject of the present invention with the dielectric wire in a metallic shield.

The introduction of equation (7) has considerable consequences. According to equation (4) y then=0 and therefore, according to equation (1)

$$J_n(x)=O \text{ or } x=u_{nm} \quad (8)$$

for $HE_{nm}$ waves ($u_{nm}=m^{th}$ root of the Bessel function of the $n^{th}$ order) and $$\frac{Jn'(x)}{xJn(x)|_{y=0}}= \quad (9)$$

-continued $$\frac{\frac{a^{2n}-a^2}{n-1}+\frac{a^2-a^{-2n}}{n+1}-\frac{n}{x^2}\left(1+\frac{\mu_1\epsilon_1}{\mu_2\epsilon_2}\right)(a^{2n}-a^{-2n})}{\frac{\mu_1}{\mu_2}(a^n+a^{-n})^2+\frac{\epsilon_1}{\epsilon_2}(a^n-a^{-n})^2}$$

for $EH_{nm}$ waves (n=0,1,2,3, . . . ). In the special case n=0:

$$J_o(x)=O \text{ or } x=u_{om}(=2.4048 \text{ for } m=1) \tag{10}$$

for $E_{om}$ waves and $$\frac{J_o'(x)}{xJ_o(x)|_{n=0}^{y=0}}=\frac{1}{2}\frac{\mu_2}{\mu_1}(a^2-1) \tag{11}$$

for $H_{om}$ waves. With known pairs of values x, y, the associated radius of the dielectric wire can be given directly by equation (5). Because y=0, it follows for this, easily calculated, for example for the $HE_{nm}$ waves which are of particular interest here:

$$R_1=\frac{u_{nm}\lambda}{2\pi\sqrt{\mu_{r1}\epsilon_{r1}-\mu_{r2}\epsilon_{r2}}} \tag{12}$$

in which λ signifies the operating wavelength in free space and $\mu_r$, $\epsilon_r$ are now the relative substance constants.

(b) Attenuation ratios

In the case y=0, the field components only follow Bessel functions in the dielectric wire, outside the wire there are pure power functions. In addition, with the $HE_{nm}$ waves there are no longer any longitudinal components outside the wire. Consequently, the transmitted power and the galvanic and dielectric losses and hence the attenuation can be calculated explicity precisely. In the case of the $HE_{nm}$ waves, on the assumption that the substance between dielectric wire and metal tube is free of loss, the general formula $$\alpha|_{y=0}=\frac{\pi}{\lambda}\sqrt{\mu_{r2}\epsilon_{r2}}\;\frac{\left[\frac{\mu_1}{\mu_2}+\frac{\epsilon_1}{\epsilon_2}Tg^2(n/n(a))\right]tg\delta+\frac{\theta}{R_2}\frac{(\mu_1/\mu_2)}{\cos^2(n/n(a))}}{\frac{\epsilon_2}{\epsilon_1}+\frac{\mu_2}{\mu_1}Tg^2(n/n(a))+\frac{2}{n}Tg(n/n(a))} \tag{13}$$

is obtained (it being assumed that the field distribution in the line suffering from loss is approximately the same as in the case without loss), in which δ designates the loss angle of the dielectric wire $\mu_L$ the permeability of the shielding tube and $$\theta=\frac{1}{2\pi}\sqrt{\frac{\lambda}{30\sigma\,u_{rL}}}\;cm \tag{14}$$

the extent of penetration of the electromagnetic wave into the tube wall (σ=electrical conductivity in S/cm). Equation (13) is written as the individual terms result directly from calculation so that the influence of the various quantities on the attenuation can be recognized immediately.

In the case which is particularly interesting in practice, namely for $$\mu_{rL}=\mu_{r2}=\mu_{r1}=1,\ \epsilon_{r2}=1,\ \epsilon_{r1}=\epsilon_r$$

it follows from equation (13) that $$\alpha|_{y=0}=\frac{\pi}{\lambda}\;\frac{[1+\epsilon_r Tg^2(n/n(a))]\,tg\delta+\frac{\theta}{R_2}\frac{1}{\cos^2(n/n(a))}}{\frac{1}{\epsilon_r}+Tg^2(n/n(a))+\frac{2}{n}Tg(n/n(a))} \tag{15}$$

(valid for $HE_{nm}$ waves, n=0,1,2 . . . ) while according to equation (12) with a given tube diameter $D_2$ now $$a=\frac{\pi D_2}{u_{nm}\lambda}\sqrt{\epsilon_r-1} \tag{16}$$

the particular diameter ratio $a=D_2/D_1$. It must be noted that a must always be ≧1. $\epsilon_r$ must therefore have a certain minimum value for every $\mu_{nm}$ value. The condition for this, for a=1, follows from equation (16) as $$\epsilon_r \geqq 1+\left(\frac{u_{nm}}{\pi}\right)^2\left(\frac{\lambda}{D_2}\right)^2 \tag{17}$$

Equation (15) now shows a remarkable behaviour. For n>>1 it follows first that $$\alpha|_{n>>1}^{y=0}\cong\frac{\pi}{\lambda}\epsilon_r\,tg\delta \tag{18}$$

The attenuation increases proportionately with $\epsilon_r$ and does so substantially independently of n and a. On the other hand, if n=0 (dominant mode) then it follows from equation (15) that $$\alpha|_{n=0}^{y=0}=\alpha_o=\frac{\pi}{\lambda}\;\frac{tg\delta+\frac{\theta}{R_2}}{\frac{1}{\epsilon_r}+2\ln(a)}\;Np/cm \tag{19}$$

In this case the attenuation constantly decreases as $\epsilon_r$ increases and does so substantially in inverse proportion to ln(a), a being given by equation (16). Theoretically, therefore, with very high $\epsilon_r$ values, it is possible to reach the attenuation zero, regardless of the galvanic and dielectric losses. The reason for this interesting behaviour, lies, as calculation shown, in that for n≧1 the transmitted power is propagated predominantly in the dielectric wire but for n=0 mainly outside the dielectric wire. The field components and hence the power density can (for n=0) assume very high values at the outside of the wire surface as the diameter of the wire decreases, so that when the energy transport is primarily effected only there. This also explains the fact that with an increasing ratio $a=D_2/D_1$, the influence of the galvanic and dielectric losses is reduced to the same extent.

Figure 3:
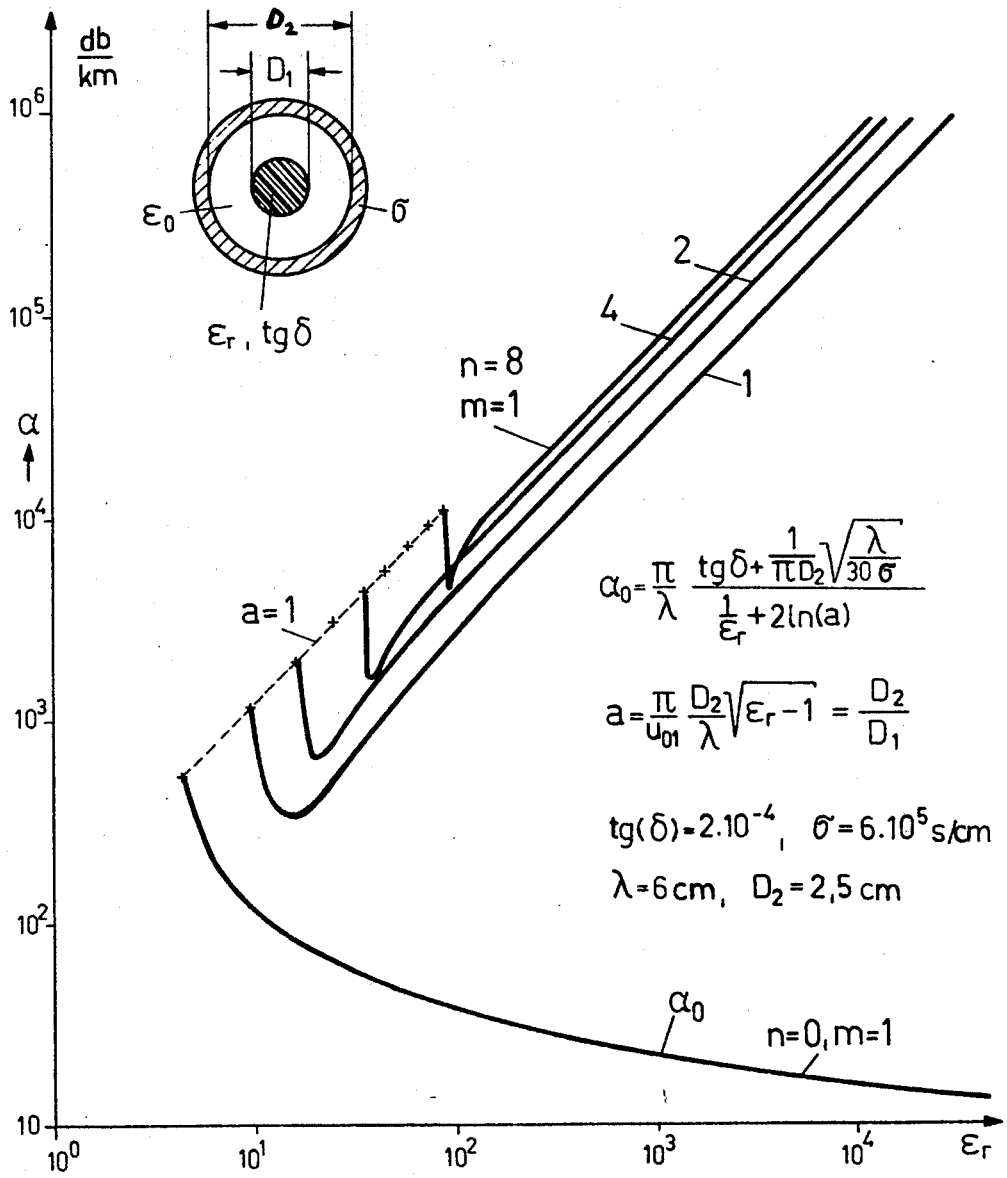
FIG. 3 illustrates the behaviour of the attenuation depending on the permittivity $\epsilon_r$ for n=0, 1, 2, 4, 8 and m=1.

FIG. 3 illustrates, with reference to an example the behaviour of the attenuation, calculated according to equation (15) depending on the permittivity $\epsilon_r$ for n=0,1,2,4,8 and m=1. Assumptions: transmission frequency $f=5$ GHz and $\lambda=6$ cm, internal diameter of the shield tube $D_2=25$ mm, furthermore $tg\delta=2.\ 10^{-4}$, $\sigma=60.\ 10^4$S/cm. Whereas the attenuation for $n\geqq 1$ rises greatly after a slight decrease, for $n=0$ it decreases constantly. Even with relatively low $\epsilon_r$ values, the difference amounts to several powers of ten. For $\epsilon_r=2000$ for example, $\alpha=60.3$ db/m with $n=1$, whereas only $\alpha=0.019$ db/m with $n=0$, in which case here $a=24.3$, that is to say the diameter $D_1=D_2/a$ of the dielectric wire only amounts to 1.0 mm.

The similar calculation for the $EH_{nm}$ waves is considerably more complicated and extensive so that here the general attenuation formula is dispensed with. In the special case of the $H_{om}$ waves ($n=0$), on the assumption that $a>>1$ there follows the expression $$\alpha\Big|_{\substack{y=0\\n=0\\a>>1}} = \frac{\pi}{\lambda}\ \frac{\epsilon_r tg\delta + \frac{\theta}{R2}\left(\frac{\lambda}{\pi R2}\right)^2}{1+2(n\ln(a)-\frac{3}{4})}\ Np/cm \tag{20}$$

in which a is again apparent from equation (16) but the value $\mu_{nm}$ has to be replaced by the value x and $u_{o1}<x\leqq u_{11}$ represents a solution of equation (11) ($u_{11}=3.83171$). The most important result revealed is that with the $EH_{nm}$ waves, the attenuation in the case of $n=0$ increases approximately as $\epsilon_r/\ln(a)$ (see equation (20)), but for $n\geqq 1$ it rises in proportion to $\epsilon_r$, that is to say in any case without restriction with $\epsilon_r$ increasing.

Thus of all the possible modes, the $E_{om}$ waves are the only ones with which the attenuation constantly decreases with increasing permittivity of the dielectric substance. The most favourable case is for $m=1$ (first root of $J_o(x)=0$, $x=u_{01}=2.40482$), because then, according to equation (12), the necessary diameter of wire $$D_1 = \frac{U_{01}}{\pi}\ \frac{\lambda}{\sqrt{\epsilon_r - 1}} \tag{21}$$

has the lowest value or the ratio $a=D_2/D_1$ assumes the highest amount with a given diameter $D_2$. With regard to a minimum value of $\epsilon_r$, equation (17) likewise applies, in which the root value $u_{01}$ now has to be put for $u_{nm}$. Instead of equation (17), however, it is also possible to give the critical wavelength $\lambda_c$, defined by (from (16) for $a=1$)

$$\lambda c = \frac{\pi}{U_{01}} D_2 \sqrt{\epsilon_r - 1} \tag{22}$$

above which transmission is no longer possible.

With regard to the tube diameter $D_2$ there is, in principle, no upper limit apart from $D_2\neq\infty$. The enforced field pattern according to power functions between dielectric wire and tube wall does not contain any nodal points and is therefore retained, true to shape, for every $D_2$ value. There are therefore other points of view for the particular selection of $D_2$, for example lowest possible attenuation or smallest possible conductor cross-section and also economic considerations.

With regard to the influence of the other substance constants, equation (13) shows for $n=0$ that the attenuation varies, inter alia, in proportion to $\sqrt{\epsilon_{r2}/\mu_{r2}}$. This could therefore be additionally reduced by making the permeability $\mu_{r2}>1$, that is to say filling the space between dielectric wire and shielding tube with a ferrite for example. Such permeable substances have a relative permittivity $>1$, however, and in addition they suffer from a loss angle so that in this case the total attenuation would become greater rather than less. Furthermore, in the numerator, the loss angle $tg\delta$ appears multiplied by the permeability $\mu_{r1}$. Thus the case $\mu_{r1}>1$ would have the effect of a greater loss angle of the wire medium. A tubular conductor of a permeable substance ($\mu_{rL}>1$) would also lead to a greater attenuation. The above assumption $\mu_{rL}=\mu_{r2}=\mu r1=1$ and $\epsilon_{r2}=1$ (see equation (15)) therefore produces the most favourable conditions with regard to these substance constants on the attenuation, also in view of the fact that, by hypothesis, $\mu_{r2}\epsilon_{r2}$ should, as far as possible be $<<\mu_{r1}\epsilon_{r1}$.

According to equation (21), with a certain permittivity of the dielectric substance, a certain diameter of wire $D_1$ is associated with each operating frequency. If the frequency deviates from that value, then an electrical longitudinal field develops on the surface of the wire, apart from the radial one. Although this causes a certain increase in the field components in the dielectric wire, it can be assumed that its influence on the attenuation only becomes apparent with a disturbing effect with relatively great difference in frequency. Obviously the attenuation is precisely at a minimum at that frequency at which the longitudinal component of the electrical field precisely disappears.

(c) Optimization conditions

The introduction of equations (14) and (16) (for $u_{nm}=u_{01}$) into equation (19) shows that $\alpha_0$ decreases in one sense depending on $\epsilon_r$ and/or $D_2$, but has a minimum depending on $\lambda$, as with the hollow waveguide waves (with the exception of the $H_{01}$ wave in the circular waveguide). For this minimum, the transcendental definitive equation $$\frac{1}{\sqrt{\epsilon_r}}\ \frac{2-\ln(\xi)}{\ln(\xi)-1} = \frac{30\sqrt{\sigma D_2 tg\delta}}{\sqrt[4]{\epsilon_r}}, \tag{23}$$

is obtained from (19), in which approximately $(\sqrt{\epsilon_r-1})(e^{\frac{1}{2}}\epsilon_r)\simeq\sqrt[2]{\epsilon_r}$ (error $\leqq 1\%$ for $\epsilon_r\geqq 4$) and $\sqrt{30\mu_{01}\pi}\simeq 15$ are put. In equation (23) only known quantities appear on the right, the function value $\xi$ also being determined. With this coefficient, the optimum operating wavelength is $$\lambda_{opt} = \frac{\pi}{u_{01}}\ \frac{D_2}{\xi}\ \sqrt{\epsilon_r - 1}\ e^{\frac{1}{2}}\epsilon_r = \frac{\pi}{u_{02}}\ \frac{D_2}{\xi}\ \sqrt{\epsilon_r} \tag{24}$$

and according to equation (16) for the corresponding diameter ratio $$a_{opt}=\xi e^{-\frac{1}{2}}\epsilon_r \tag{25}$$

or for $\epsilon_r>>1$ simply $a_{opt}=\xi$. The right-hand side of equation (23) can theoretically run through all the numerical values from 0 to $\infty$. For the left-hand side, on the other hand, the value zero/lies at $\xi=e^2$ and the value infinity at $\xi=e$ ($e=2.72828$). For all possible positive numerical values of the right-hand side of equation (23) therefore, $\xi$ can vary at most in the range $$e\leqq\xi\leqq e^2 \tag{26}$$

This statement also applied to the particular diameter ratio according to equation (25). Lower $\xi$ values correspond to low $\epsilon_r$ values, higher $\xi$ values to the very high $\epsilon_r$ values.

If the optimization conditions according to the equations (23) and (25) are inserted in equation (19), then the simple formula $$\alpha_{omin} = \frac{\pi}{2\lambda_{opt}} \frac{tg\,\delta}{2 - \ln(\xi)} \tag{27}$$

is ultimately obtained for the minimum attenuation, $\lambda$opt being determined by equation (24), or, as a comparison with equations (22) and (25) shows by $$\lambda_{opt}=\lambda_c/a_{opt} \text{ or } f_{opt}=f_c \cdot a_{opt} \tag{28}$$

The associated diameter ratio $a_{opt}$ only applies for those conditions under which the attenuation has a relative minimum with $\lambda$opt. If the diameter ratio a is selected greater than $a_{opt}$ for example, then it is true that lower attenuation values are obtained but the minimum attenuation is then still lower and is at a higher optimum wavelength, in which case a correspondingly larger diameter of wire appears, so that a again becomes $a_{opt}$. For example, for $D_2=25$ mm, $tg\delta=2.10^{-4}$ and $\sigma=60\cdot10^4$ S/cm with $\epsilon_r=2000$, a minimum damping of $\alpha_{Omin}=10.3$ db/km is obtained, the optimum operating frequency amounting to 765 MHz and the wire diameter $D_1$ should be selected $=6.7$ mm. In the earlier similar example with reference to equation (15), on the other hand, there was an attenuation of $\alpha_0=19$ db/km and a wire diameter of only 1.0 mm, based on an operating frequency of 5 GHz. As can be seen, the attenuation minimum is very flat so that a relatively great frequency deviation is necessary for the difference to become noticeable.

As this exposition shows, there are various possible dimensions in principle: Either the diameter ratio is adapted to the particular permittivity of the wire substance directly with a given operating frequency, or this is determined so that a minimum attenuation occurs at the same time. In the first case, with very high $\epsilon_r$ values, this leads to very thin dielectric inner conductors, practically in filament form, (see equation (21)), in the second case, because then the diameter ratio can vary at most by the factor e, it leads to very low operating frequencies (see equation (24)). In both cases the attenuation decreases monotonously, in the first case substantially logarithmically, in the second case approximately with the square root of the permittivity. For the same operating frequencies, the attenuation is also a minimum in the first case, for which the associated $\epsilon_r$ value can be calculated. In the above examples, this is the case with $\epsilon_r=34$ for 5 GHz, for which value $_{omin}=53.8$ db/km and $D_1=8.0$ mm $\phi$.

(d) Comparison with known kinds of line

Depending on the value of $\xi$, the proposed line system may possible have considerably more favorable characteristics than, for example the coaxial line or even certain types of hollow waveguide, either with regard to attenuation with the same external dimensions or with regard to dimensions with the same attenuation conditions, always considered at the same operating frequencies. By a comparison of the corresponding attenuation formulae, the particular improvement factor is obtained and so also the conditions under which the systems begins to behave more favourably.

For the comparison with the coaxial line, the same diameters of the outer conductors are assumed and for the size of the inner conductor those diameter conditions are introduced at which the attenuation is a minimum in each case. If tg$\delta$ from equation (23) is introduced into equation (19) and it is remembered that according to equations (16) and (25)

$$D_2 = a_{opt} \frac{U_{01}}{\pi} \frac{\lambda_{opt}}{\sqrt{\epsilon_r - 1}} \text{ with } a_{opt} = \xi e^{-\frac{1}{2}\epsilon_r} \tag{29}$$

then the formula $$\alpha_{min}^{QD} = \frac{1}{4D_2\sqrt{30\sigma\lambda_{opt}}} \frac{1}{\ln(\xi) - 1} \tag{30}$$

follows for the minimum attenuation of the QD line. Assuming the same substance constants of the conductors and air as the intermediate medium, the attenuation of the coaxial line is determined by $$\alpha^{KA} = \frac{1}{2D\sqrt{30\sigma\lambda}} \frac{1 + b}{\ln(b)} \tag{31}$$

in which the diameter ratio $b=D/d$ is present not only in the denominator but also in the numerator. The minimum of this fuction is $b_{opt}\cong3.6$. With this value inserted, the minimum attenuation is $$\alpha_{min}^{KA} = \frac{b_{opt}}{2D\sqrt{30\sigma\lambda}} \tag{32}$$

The quantities $b_{opt}$ and D are here independent of the particular operating frequency. For $\lambda=\lambda_{opt}$ and $D=D_2$, the comparison of (30) and (32) shows a ratio of the attenuation constants of $$v = \alpha_{min}^{QD}/\alpha_{min}^{KA} = 1/[2b_{opt}(\ln(\xi) - 1)] \tag{33}$$

In the above-mentioned range of validity of $\xi$ according to equation (26) thereof $v=\infty$ with $\xi=e$ and $v=1/(2b_{opt})\cong0.14$ with $\xi=e^2$. With this comparison therefore, the attenuation of the QD line, based on equal external diameter, conductivities and operating frequencies, can at best amount to 14% of the value of the coaxial line. For $v=1$, the necessary minimum value of $\xi$ is $$\xi_{min}=\sqrt{eb_{opt}}=3.12437 \tag{34}$$

from (33), at which value the two lines are equivalent in behaviour. Thus, if follows from equation (23) that for a more favorable behaviour of the QD line in comparison with the coaxial line, it is necessary for $$\frac{30\sqrt{\sigma D_2}}{\sqrt[4]{\epsilon_r}} tg\delta < \frac{2b_{opt} - 1}{\sqrt[4]{eb_{opt}}} \cong 3.5 \tag{35}$$

In comparison with the coaxial line, therefore, $\xi$ may only vary in the range $$1.15\cdot e \leqq \xi \leqq e^2 \tag{36}$$

in order that there may be more favorable conditions on the QD line.

Functionally, the QD line behaves like a coaxial line, the inner conductor of which is an infinitely good conductor and the outer conductor of which has a correspondingly lower conductivity. For a coaxial line in which the conductivity of the inner conductor $\sigma_1=\infty$, the attenuation formula is $$\alpha=\frac{\pi}{\lambda}\;\frac{\frac{1}{2\pi D}\sqrt{\frac{\lambda}{30\sigma_r}}}{\ln(b)} \tag{37}$$

in which $b=D/d$ can now be as desired and $\sigma_r$ signifies a correspondingly modified conductivity of the outer conductor. After insertion of $\theta$ from (14), for $b=a\cdot e^{\frac{1}{2}\epsilon_r}$ and $D=D_2$, the comparison with equation (19) gives the identity $$\frac{1}{\pi D_2}\sqrt{\frac{\lambda}{30\sigma_r}}=tg\delta+\frac{1}{\pi D_2}\sqrt{\frac{\lambda}{30\sigma}} \tag{38}$$

and from this, for the resulting conductivity of the outer conductor the relationship $$\sigma_r=\frac{\sigma}{\left[1+\pi D_2\frac{30\sigma}{\lambda}\cdot tg\delta\right]^2} \tag{39}$$

The denominator of equation (39) is independent of the ratio $a=D_2/D_1$. The losses of the dielectric wire appear in fact in the form of additional losses in the outer conductor. This transformation effectively has the effect that according to equation (19) the attenuation is influenced by the diameter ratio a merely in the denominator depending on ln(a) (in contrast to the coaxial line, see equation (31)) and therefore can assume as small values as desired for very small wire diameters ($a\rightarrow\infty$). The QD line corresponds formally precisely to a coaxial line, the inner conductor of which has an infinitely high conductivity, that is to say is to some extent superconducting.

With regard to the optimum case, the denominator in equation (39) can be replaced by the equations (23) and (24), so that it becomes $$\sigma_r=4\sigma(1-1/7n(\xi))^2 \tag{40}$$

In fact, it follows from this that for $\xi=e$: $\sigma_r=0$, for $\xi=1.15\cdot e$ (lower limit in equation (36): $\sigma_r=0.06\sigma$, for $\xi=e^2$: $\sigma_r=\sigma$. Thus in the case $\xi=1.15\cdot e$ (QD line identical with coaxial line as regards attenuation), the resistance transformed in the outer conductor is greater by the factor 15.7 than shown by the outer conductor itself. The dielectric losses must be very high for the proposed waveguide no longer to be competitive with the coaxial line.

In the comparison with the rectangular hollow waveguide which is generally used ($TE_{01}$ wave), the same tube cross-sections are assumed for the sake of simplicity and it will be shown under what conditions the QD line behaves similarly or more favorably. If A designates the broad side of the hollow waveguide, then with the usual side ratio of 1:2, the external diameter of the QD line is determined by $$D_2=A\sqrt{2/\pi}\cong 0.8\cdot A \tag{41}$$

It is known that the critical wavelength of the rectangular hollow waveguide is $\lambda_c=2A$ (air-filled), and the operating frequency is in the range $f=(1.25-1.9)\,f_c$. The transmission attenuation is normally given for $f=1.5f_c$.

Depending on the frequency, the minimum attenuation with a side ratio of 1:2 is $f=(1+\sqrt{2})\cdot f_c$, that is to say outside the working range. What are compared here are the attenuations with $f=1.9f_c$ (lowest value in the operating range). With $A=\lambda_c/2=1.9\cdot\lambda/2$, therefore, it follows that $$D_2=1.9/\sqrt{2\pi}\,\lambda \tag{42}$$

On the other hand, according to equation (16)

$$D_2=\lambda\frac{U01}{\pi}\;\frac{a}{\sqrt{\epsilon_r-1}} \tag{43}$$

applies for the external diameter of the QD line.

Because $1.9/u_{01}\cdot\sqrt{\pi/2}\cong 1$ (error $<1\%$), the comparison with (42) thus gives the relationship $$a=\sqrt{\epsilon_r-1}\text{ or }\epsilon_r=1+a^2 \tag{44}$$

for the particular diameter relationship.

According to (19) with from (14) ($\mu_{rL}=1$)

$$\alpha^{QD}=\frac{1}{2D_2\sqrt{30\,\sigma\lambda}}\;\frac{1+\pi D_2\sqrt{\frac{30\sigma}{\lambda}}\;tg\delta}{\frac{1}{2\epsilon_r}+\ln(a)} \tag{45}$$

applies for the attenuation of the QD line.

On the other hand, with $f=1.9\cdot f_c$, the attenuation on the rectangular hollow waveguide is determined by $$\alpha^{RH}=1.502/A\sqrt{30\sigma\lambda} \tag{46}$$

Figure 4:
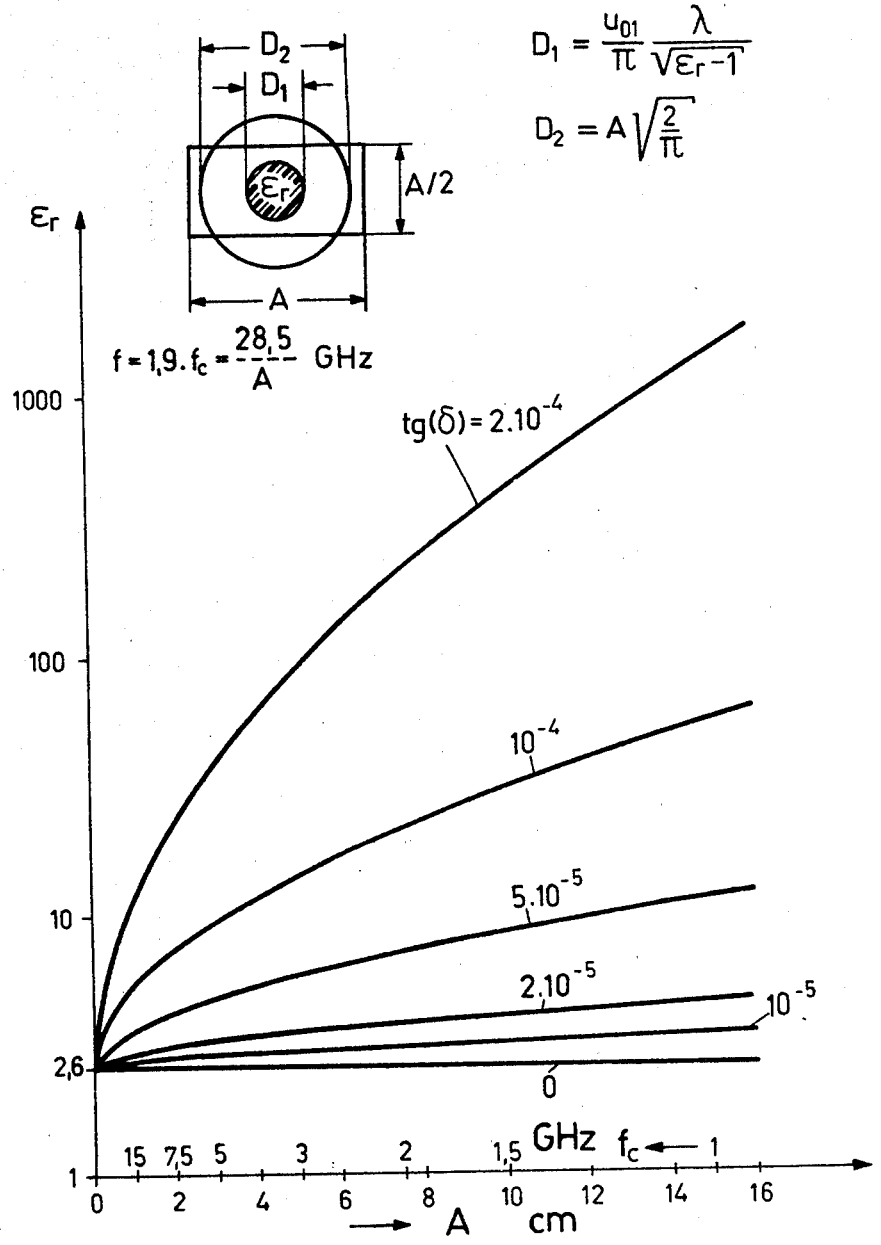
FIG. 4 illustrates the behavior of the permittivity $\epsilon_r$ depending on the dimension of the broad side of the hollow waveguide A or the critical frequency $f_c$.

Finally, the comparison of (45) with (46) provides, with (41) for the permittivity of the dielectric wire of the QD line, the equation of condition $$Tn(\epsilon_r-1)+1/\epsilon_r)\geqq 0.854+2.04\sqrt{30\sigma A}\;tg\delta \tag{47}$$

in which a according to equation (44) is expressed by $\epsilon_r$. The particular minimum value necessary is essentially determined by the quantity $\sqrt{\sigma A}$. tgδ. In FIG. 4, the behaviour of $\epsilon_r$ is shown depending on A with tgδ as a parameter for tubes of copper ($\sigma=57.10^4$S/cm). The higher tgδ is, the greater $\epsilon_r$ must be in order to compensate for the attenuating effect of the dielectric wire. In the ideal case tgδ=0, independent of frequency, a minimum value of the permittivity of only $\epsilon_r=2.6$ is necessary, in which case, then, according to equation (44) the diameter ratio $a=1.265$ and $D_1=0.637.A$.

The QD line behaves more favorably, in comparison with the rectangular hollow waveguide, in all those frequency ranges in which the particular permittivity of the wire medium is greater than that value which emerges from the limiting curve shown in FIG. 4 according to the loss angle suffering from the dielectric substance. With $\epsilon_r=10$, for example, a lower attenuation is first reached from 36 GHz on with $tg\delta=2\cdot10^{-4}$, whereas it is reached from 9.2 GHz with $tg\delta=10^{-4}$ from 2.3 GHz with $tg\delta = 5.10^{-5}$ and so forth. The particular frequency range which is favored is relatively great even for substances with relatively low $\epsilon_r$ values, if these have a very low loss angle. With high loss angles, on the other hand, with lower $\epsilon_r$ values, a low attenuation can only be expected in the range of very high frequencies (mm waves). Then in order to obtain more favorable conditions over a relatively large frequency range, substances with comparatively high $\epsilon_r$ values are necessary, in which case, however, relatively small diameters of the dielectric wire result.

Similar comparisons with regard to the modes in the round hollow waveguide result in practically the same conditions as with the rectangular hollow waveguide for all the modes of interest with the exception of the $TE_{01}$ wave. With the $TE_{01}$ mode, it is known that the attenuation decreases continuously with the frequency in proportion to the expression $(f_c/f)^{3/2}$ ($\lambda_c = 0.82 \cdot D$, D = tube diameter), so that extremely low attenuations are obtained with very high frequencies (high $D/\lambda$ ratio), but with the disadvantage that numerous subsidiary modes appear apart from the dominant mode and may cause considerable additional losses (see introduction). The achievement of such low attenuation values is also possible with the QD line, at least theoretically. For this, however, a substance having a very high permittivity with a very low loss angle is necessary for the dielectric wire, in which case this wire (in the range of the mm waves) would only be a filament of about 0.1 mm in diameter. Such a transmission possibility would have great advantages (hollow cable long-distance traffic) because with the QD line, mode splitting cannot occur even with a very high $D_2/D_1$ ratio.

The coupling of the QD line to conventional forms of line, particularly to the usual coaxial line is relatively simple. Naturally attention must be paid to the least possible reflection in each case. As with the hollow waveguide, various characteristic impedances can also be defined here. In principle there are the three possibilities:

$$Z_{UI}\hat{U}/I,\ Z_{UP} = (\hat{U})/2P,\ Z_{IP} = 2P/(I)2 \tag{48}$$

in which $\hat{U}$ and $\hat{I}$ designate the amplitude value of the voltage between conductor axis and shield wall or the longitudinal current flowing in the dielectric wall and the shield wall respectively and P the transmitted effective power. Between these therefore, there is the relationship $$Z_{UI} = \sqrt{Z_{UP} \cdot Z_{IP}} \tag{49}$$

From the field equations there follows because of $xJ_1(x) \cong 1.25$ for $x = u_{01} = 2.4048$ $$Z_{ui} = 60\sqrt{\frac{\mu_{r2}}{\epsilon_{r2}}}\left(0.8\frac{\epsilon_2}{\epsilon_1} + \ln a\right) \tag{50}$$

$$Z_{IP} = 60\sqrt{\frac{\mu_{r2}}{\epsilon_{r2}}}\left(0.5\frac{\epsilon_2}{\epsilon_1} + \ln a\right) \tag{51}$$

so that according to equation (49), $Z_{UP}$ is also determined. For $\epsilon_1 >> \epsilon_2$ the simple formula ($\mu_{r2} = 1, \epsilon_{r2} = 1$)

$$Z_o = 60 \cdot ln(a)\Omega \tag{52}$$

is obtained in all three cases for the characteristic impedance of the QD line, which coincides precisely with that of the conventional coaxial line. With the same conductor diameters, therefore, a direct transition from the one form to the other is possible. Unequal characteristic impedances require a coupling, for example via $\lambda/4$ transformers, with thin dielectric wires, preferably by means of resonance transformers, for example magnetically in the $\lambda/4$ spacing from the free end of the wire. The same applies to the coupling to the various hollow waveguides.

Technical progress

Whereas all conventional line systems need a relatively large cross-section of the energy flow for a low-loss transmission, a low attenuation can be achieved in the proposed waveguide even with a small transmission cross-section. Through the dielectric wire, with increasing permittivity, the power density is concentrated to an increasing extent on the environment of the surface of the wire, but the wire itself is ever more decoupled from the surrounding field. In the limiting case of a very high permittivity, the power transmission is effected practically only in the center of the shield tube along the surface of the dielectric conductor in the form of a filament. At the same time, extremely low attenuations can be achieved, as explained in the previous section. A prerequisite for this phenonomen is that there should be substantially only an electrical radial field at the surface of the wire. This is weaker by the factor $\epsilon_1/\epsilon_2$ in the dielectric wire than outside the wire, and accordingly also the proportion of power transmitted in the wire. With the selection of the wire diameter in such a manner that in the dominant mode ($E_{01}$ wave), a TEM wave appears in the space between wire and shield tube, this condition is necessarily fulfilled. With all other field structures of the $HE_{nm}$ waves (n = b 1, 2, 3 . . . ) and the $EH_{nm}$ waves (n = 0, 1, 2, 3 . . . ) there is also always an $E\phi$ component present. According to the transition conditions for tangential fields at boundary surfaces, this is always equally great in the interior wire as that at the surface outside the wire. The proportion of power transmitted in the wire is also correspondingly high with these modes, so that here the dielectric losses are fully included and cause a very great attenuation. The $E_{om}$ waves (particularly the $E_{01}$ wave) are, in fact, the only modes with which a low-loss transmission can be achieved.

With the wire diameter based on the dominant mode ($E_{01}$ wave) only this wave is capable of existence. Higher modes are only possible with a correspondingly higher frequency. Only those of the $E_{om}$ type (m = 1, 2, 3, 4 . . . ) are capable of propagation, however, while all the others remain ineffective because of the high attenuation. Since there is the least attenuation with the $E_{01}$ mode, operation of the line in a state in which higher modes are also possible, is not recommended. Accordingly, mode conversions in the event of an accidental deviation of the conductor contours from the ideal shape, therefore cannot occur here.

The QD line is insensitive to possible extraneous disturbances. It only transmits electromagnetic energy above its critical frequency. Voltages induced along the metallic outer conductor can therefore not appear as potential differences between shield tube and dielectric wire at the ends of the line.

The proposed waveguide has fundamental importance. For the first time a transmission possibility for electromagnetic waves is disclosed which includes the limiting case (for $\epsilon_r \rightarrow \infty$, that is to say $D_1 \rightarrow 0$, $D_2 \neq 0$, but as small as desired) of a disappearing attenuation with disappearing cross-sectional area of the energy flow, independently of any galvanic and dielectric losses. This characteristic is possible because the QD line, as explained under "Theoretical results", section (d), corresponds precisely in form to a coaxial line, the inner conductor of which has an infinitely high conductivity. In practice, it is possible to approach as close as desired to this ideal case, provided that the dielectrics necessary for this are available. In the higher frequency range, considerably lower attenuations can be achieved with comparatively low $\epsilon_r$ values, than are displayed, for example, in the coaxial line or certain hollow waveguides, or very small conductors cross-sections can be obtained with the same attenuation values.

As explained above with reference to the circular coaxial line system, the diameter of the dielectric wire is selected so that with given permittivities and frequency, a TEM wave develops at least substantially in the space between wire and shield wall. As mentioned, these field components are pure power functions, belong therefore to the two-dimensional potential equation and so to the calculating rules of the conformal representation. From this it can be concluded that the results explained here for the coaxial conductor system also apply to forms of conductor which can be derived from the field between two concentric circles by conformal representation. These include, for example, rectangular and elliptical cross-sectional shapes, dielectric wire between metal plates and the like. For every such cross-sectional shape of the QD line, with analogous excitation of the $E_{01}$ wave ($m=1$), there must always be a frequency at which the electric field lines are perpendicular to the surfaces along the whole periphery of the dielectric wire. Otherwise there would be contradictions in the field pattern in the back transformation of the conductor contours to the circular shape.

In principle, multi-wire systems can also be constructed with reference to the relationships obtained for the coaxial QD line. Adhering to the transmission symmetry, imposes such high requirements with regard to the coupling conditions as well as the uniformity and homogeneity of the wire system (the same power transported throughout and specific phase position of the individual $E_{01}$ waves) that such systems can scarcely be considered in practice, even in the form of a double line. In addition, relatively high attenuations would have to be expected because here the dielectric losses play a greater part than in the coaxial case.

The proposed line system can be used above the critical frequency to far into the highest frequency range of the mm waves. The concrete use is primarily a question of the dielctric materials available. In the range of very high frequencies (mm waves) substances having relatively low permittivity suffice, while in the microwave range down to the dm waves, higher to very high values are necessary.

The dielectric wire can, in principle, consist of any antimagnetic substance. Essentially these are plastic materials, ceramic, glass or even a liquid embedded in an insulating tube which can be flexible. At present only a few substances are known which are suitable for this. Various ceramic substances have a permittivity between $\epsilon_r=10-100$ with a loss angle of $tg\delta=(0.7-5)\cdot 10^{-4}$. Further there exist certain mixed ceramics containing titanium and zirconium or strontium and barium, some of which have very high $\epsilon_r$ values, but also relatively high loss angles. Also low-loss glasses, such as are used today for the production of low-attenuation glass optical fibers, may be considered. It is known that, as with water, so with glass the permittivity at low frequencies is considerably higher than at light frequencies, for example tellurium glass: refractive index $n\cong 2.2$, static permittivity $\cong 25$. In addition, these glasses should also have relatively low-loss angles in the microwave range. In this manner, a monomode fiber for mm waves could result from a multimode fiber in the light wave range.

The use of the proposed quasidielectric waveguide is predominantly a technological problem. The line could advantageously replace the present kinds of line (coaxial line, waveguide) in many fields of the transmission art, either in order to achieve very low attenuations or to produce miniaturized lines.

A concrete possible application of the QD line exists already with very short lengths of line such as are needed, for example, for filter purposes. As the calculation shows, other effects show to advantage here so that the natural circuit Qs which can be achieved with such resonators are higher by a multiple than correspond to the natural qualities ($ctg\delta$) of the dielectric substance.

Figure 5A:
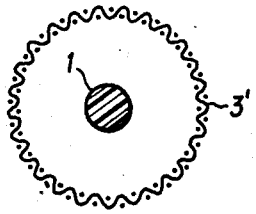
FIGS. 5A, 5B and 5C are cross-sectional illustrations of alternate embodiments of the waveguide of the invention.
Figure 5B:
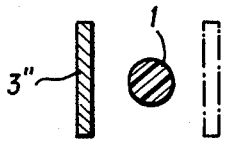
Figure 5C:
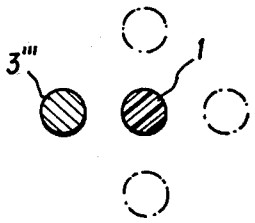

It is further noted that while the tube (3) has previously been described as being a metal tube, the tube (3) may otherwise be formed of cylindrical metallic wire gauze, or at least one metal plate, or at least one metallic wire parallel to the dielectric wire (1), as respectively schematically illustrated in perspective in FIGS. 5A, 5B and 5C.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A waveguide for the transmission of electromagnetic energy, comprising:
   - a cylindrical metallic sheath functioning to guide forward electromagnetic waves;
   - a wire-shaped body disposed coaxially in the interior of said sheath, said sheath and said wire-shaped body defining an intermediate space therebetween;
   - a medium having a low dielectric constant ($\epsilon_2$) located in the space between said sheath and the wire-like body:
   - said wire-shaped body consisting solely of a dielectric material exhibiting a high dielectric constant ($\epsilon_1$) such that an $E_{om}$ wave (circular H field) can be excited only in the dielectric wire-shaped body, the dimensioning of the dielectric wire-shaped body being such, depending on the dielectric constants $\epsilon_2$ and $\epsilon_1$, and the particular operating frequency, so that a substantially pure TEM wave can develop at least substantially in the intermediate space.

2. The waveguide as claimed in claim 1, wherein the $E_{om}$ wave excited in the dielectric wire is an $E_{01}$ wave ($TM_{01}$ mode).

3. The waveguide as claimed in claim 1, wherein the permeability $\mu_2$ of the medium and the permeability $\mu_1$ of the dielectric wire-shaped body are equal to the vacuum permeability $\mu_0$, and the dielectric constant $\epsilon_2$ of the medium is at least substantially equal to the vacuum dielectric constant $\epsilon_0$, while the dielectric constant $\epsilon_1$ of the dielectric wire-shaped body is considerably higher.

4. The waveguide as claimed in claim 1, wherein the medium in the space between said sheath and said wire-shaped body is predominantly air.

5. The waveguide as claimed in claim 1, wherein the metallic sheath is a circular cylindrical metal tube.

6. The waveguide as claimed in claim 1, wherein the metallic sheath consists of a cylindrical metallic wire gauze.

7. The waveguide as claimed in claim 1, wherein the wire-shaped body has at least a substantially circular cross-section.

8. The waveguide as claimed in claim 1, wherein the dielectric wire-shaped body is disposed concentrically in the interior of the metallic sheath.

9. The waveguide as claimed in claim 1, wherein the dielectric wire-shaped body comprises a plastic material.

10. The waveguide as claimed in claim 1, wherein the dielectric wire-shaped body consists of a ceramic material.

11. The waveguide as claimed in claim 1, wherein the dielectric wire-shaped body consists of a glass wire.

12. The waveguide as claimed in claim 1, wherein the dielectric wire-shaped body comprises a liquid.

13. The waveguide as claimed in claim 12, said wire-shaped body further comprising:

a flexible tube filled with said liquid.

* * * * *